US006419565B2

(12) United States Patent
Mattson et al.

(10) Patent No.: US 6,419,565 B2
(45) **Date of Patent: *Jul. 16, 2002**

(54) ROTARY FLOOR FINISHER FOR USE WITH A POWER RIDER TRAILER

(75) Inventors: Bryan Mattson, Delton; Michael T. Powers, Woodland, both of MI (US)

(73) Assignee: Floor Style Products INC, Hastings, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/738,459

(22) Filed: Dec. 14, 2000

Related U.S. Application Data

(62) Division of application No. 09/262,133, filed on Mar. 3, 1999.

(51) Int. Cl.[7] ..... B24B 1/00; B62D 51/04

(52) U.S. Cl. ..... 451/59; 451/353; 180/19.3; 180/12

(58) Field of Search ..... 451/59, 353, 359, 451/350; 15/49.1, 98, 333, 354; 180/11, 12, 13, 19.1, 19.2, 19.3

(56) References Cited

U.S. PATENT DOCUMENTS

| | | | | |
|---|---|---|---|---|
| 694,077 A | | 2/1902 | Raasch et al. | |
| 1,299,989 A | | 4/1919 | Miller | |
| 2,201,420 A | | 5/1940 | Zschau | |
| 2,205,671 A | | 6/1940 | Sarber | |
| 3,024,858 A | | 3/1962 | Davis et al. | |
| 3,037,755 A | | 6/1962 | Hatcher | |
| 3,087,712 A | | 4/1963 | Hatcher | |
| 3,090,647 A | | 5/1963 | Moore | |
| 3,161,994 A | | 12/1964 | Neitzer, Jr. | |
| 3,208,796 A | | 9/1965 | Hatcher | |
| 3,417,638 A | | 12/1968 | Haase et al. | |
| 3,424,260 A | | 1/1969 | Stone et al. | |
| 3,450,224 A | | 6/1969 | Griesenbrock | |
| 3,653,687 A | | 4/1972 | Forsyth et al. | |
| 3,705,638 A | | 12/1972 | Shock | |
| 3,867,796 A | * | 2/1975 | Sonnenberg | 51/176 |
| 3,891,042 A | | 6/1975 | Braun | |
| 4,017,136 A | | 4/1977 | Sasgen | |
| 4,030,251 A | | 6/1977 | Boettcher | |
| 4,095,637 A | | 6/1978 | Krishman | |
| 4,136,491 A | | 1/1979 | Redifer | |
| 4,413,698 A | | 11/1983 | Conrad et al. | |
| 4,530,416 A | | 7/1985 | Kassai | |
| 4,570,741 A | | 2/1986 | McCoy | |
| 4,610,558 A | | 9/1986 | Erickson | |
| 4,629,391 A | | 12/1986 | Soyk et al. | |
| 4,651,846 A | | 3/1987 | Headrick | |
| 4,793,434 A | | 12/1988 | Bachle | |
| 5,016,310 A | | 5/1991 | Geyer et al. | |
| 5,033,564 A | | 7/1991 | Mattson | |
| RE34,822 E | * | 1/1995 | Mattson | 180/11 |
| 5,575,710 A | * | 11/1996 | Kramer | 451/350 |
| 6,019,545 A | | 2/2000 | Allen et al. | |
| 6,202,775 B1 | * | 3/2001 | Mattson et al. | 180/19.3 |

* cited by examiner

*Primary Examiner*—Timothy V. Eley
(74) *Attorney, Agent, or Firm*—Stout, Uxa, Buyan & Mullins, LLP; Frank J. Uxa

(57) ABSTRACT

A rotary floor finisher for use with a power rider trailer for the sanding and screening of large wood floor areas. The floor finisher and sander to attached in substantially rigid relationship to each other and steered by a wheel provided on the floor finisher.

8 Claims, 2 Drawing Sheets

ROTARY FLOOR FINISHER FOR USE WITH A POWER RIDER TRAILER

This is a divisional application of application Ser. No. 09/262,133 filed Mar. 3, 1999.

BACKGROUND OF THE INVENTION

This present invention relates to floor finishing machines and more particularly to an improved floor finishing machine for use with a power rider trailer.

The process of finishing a new floor or refinishing an old floor is well known in the art. The steps necessary to finish or refinish a wooden floor generally include the steps of sanding the floor with successively finer grits of sandpaper or other abrasive material, then screening the floor with a mesh screen as a final abrasion to blend the sanded areas. A wooden floor can then optionally be stained, sealed and finally the surface is buffed or polished.

Powered floor sanders come in several varieties, the three most common being drum, belt and rotary sanders. A drum sander has a cylinder covered with removable sandpaper that is rotated against the floor by means of a motor. A belt sander type of floor sander has a belt of sandpaper held by two cylinders which move the belt against the wooden floor by a motor driving one or both cylinders. The cylinder or cylinders of the drum sander or belt sander rotate about the axis generally parallel to the floor.

Drum and belt sanders are designed for the heavier sanding required when finishing a newly installed floor. Drum and belt sanders must be used with care and generally only in the earlier stages of sanding a floor, when the rougher grits of sandpaper are used. These types of machines tend to gouge and scratch a floor and can't be used for the finer blending required to finish the floor.

After the sanding is completed the floor must be screened. Screening is a process of moving a fine mesh of abrasive screen across the floor to further blend wood together and make for an even surface. The screen is usually a plastic or fabric that is impregnated with an abrasive material.

The heavier sanding is not required of most floors that need to be refinished. Instead, existing floors are typically only treated to a lighter sanding in order to remove any existing layer of wax or dirt, then screened to lightly score the surface, roughing it up to make it take the next coat.

In the past a third type of sander, a rotary sander pushed by a human user, was used for the final stages of finishing a wooden floor. A rotary sander has one or more disks, each called a pad driver, driven by a motor. In a rotary sander sandpaper or screen mesh is affixed to the pad driver and rotated against the floor, about an axis generally perpendicular to the floor, by a motor. Rotary sanders are not designed to do the heavy abrasion work of the drum or belt sanders, instead they are used with the finer grits of sandpaper or mesh screen to smooth the surface in the final sanding and the screening stages. In all cases a layer of stain or sealant is applied to the prepared surface, then usually buffed and polished thereafter.

Most rotary floor sanders are designed to have the user propel the sander across a floor by pushing and pulling on the sander. Such pushing and pulling by a human user renders the desired degree of control to result in an evenly sanded floor surface. A design having the user push the rotary sander is adequate for smaller jobs but is difficult, tedious and inefficient for larger floors, such as those of gymnasiums.

Drum and belt sanders have previously been used in combination with a propelling vehicle. Such a vehicle is disclosed in Mattson, U.S. Pat. No. 5,033,564, later reissued as RE. 34,822. The disclosure of each of these patents is incorporated herein in its entirety by reference. The sander disclosed by this patent is not used in combination with a rotary sander and cannot be used to screen a floor. This propelling vehicle, hereafter referred to as a power rider trailer, is sold by the Floor Style Company of Hastings, Mich. under the trademark FLOOR MACK®.

SUMMARY OF THE INVENTION

New rotary floor finishers and methods of using such finishers have been discovered. The invention provides a new implement for use with a power rider trailer, a rotary floor finisher having many advantages.

The new rotary floor finisher allows a human to ride atop the power rider trailer while steering both the power rider trailer and the floor finisher together with a steering system incorporated into the floor finisher. The rotary sander can be used for finish sanding as well as screening.

A rotary sander in combination with a power rider trailer for sanding and screening is therefore highly advantageous for larger floor areas. Importantly, it has been found that rotary sanders coupled to power rider trailers in accordance with the patent incorporated results in a finished floor surface which is as evenly sanded and is as acceptable or identical to a floor surface treated with a rotary sander pushed and pulled directly by a human user. It is estimated that two to three times the floor area can be sanded or screened in a given time period by using a rotary sander/screener in combination with a power rider trailer, instead of using the existing push-driven models.

In one broad aspect the floor finisher is comprised of one or more motors mounted on a housing, the drive shaft of the motor or motors being vertical. Each motor drives one or more pad drivers against a floor during operation and this orientation orients the pad driver to a generally parallel relation to the floor. A supporting structure is affixed to both the hook-up bracket of the power rider trailer to hold the power rider trailer in a substantially rigid relationship to the floor finisher on a side, as well as to the housing with its motors on a second, preferably opposite side. A power rider trailer by itself has no steering mechanism. The power rider trailer drives the floor finisher across the floor while the user steers the combined unit with a handle connected to a wheel mounted on the supporting structure. The wheel both supports the floor finisher and steers the power rider trailer/floor finisher combination.

The floor finisher is attached in substantially rigid relationship to the power rider trailer. In this way the power rider trailer and the floor finisher act as a single unit is therefore much easier to operate than one that would articulate during use.

In operation each pad driver is covered with an appropriate abrasive material for a particular job, for example sandpaper or another abrasive material for sanding, mesh screen for screening. The abrasive material is attached to the face of the pad driver and contacts the floor with the force of the combined weight of the housing, motor and pad driver pushing downwardly on the material against the floor during operation.

While any type of motor can be used to drive the pad drivers, an electric motor is preferred. Moreover almost all enclosed spaces are equipped with electrical outlets, often 220 volt AC outlets, which is the preferred voltage rating of the motor, being more efficient than a standard 110 volt rated motor.

In the preferred embodiment there is additionally included an electrical switch to turn the motors on and off, as well as to regulate the speed of the pad drivers with multiple settings to adjust the RPMs of the pad driver.

A single motor can be made to drive more than one pad driver by methods well known in the art. For example, multiple pad drivers could be driven by a system of pulleys and belts.

If required, weights may also be placed atop the housing to add ballast to increase the force exerted on the pad driver against the floor. It is advantageous to be able to regulate the amount of force exerted on the abrasive material against the floor because there is an optimal amount of force for a given abrasive material. Additional weight on the pad drivers causes any given abrasive material to cause more abrasion. Too little force on the abrasive material results in an undesirable glazing or burnishing of the floor. This burnishing seals the floor, preventing it from receiving further staining or other sealants.

In the preferred embodiment the supporting structure is attached to the housing by vertical lift members which slide on linear bearings attached to the housing. In this way the housing can be raised and lowered while at the same time always keep the orientation of the plane of the pad drivers and the floor in parallel relation. This avoids the problem of an uneven weight being exerted against the pad driver disk, causing the disk to abrade the floor more on one side of the pad driver than the other, perhaps resulting in a gouge.

A pressure release member can further be incorporated to regulate the amount of pressure that the pad driver exerts on the abrasive material against the floor. The pressure release member pulls the housing and motors upwards away from the floor, raising the housing in a cantilevered fashion on the supporting structure, thereby lessening the force exerted on the abrasive material by the driver pad, housing and motor. In the preferred embodiment the supporting structure includes two vertical members, a left hand lift base and a right hand lift base. In the preferred embodiment a cable controlled by the user pulls the housing upwards. This weight or force reduction is best limited to about fifty percent of the initial combined weight of the motor and housing assembly because to too little weight on the abrasive material will result in the aforementioned glazing and burnishing of the floor.

The pad drivers can be removed from contact with the floor altogether for replacement of the abrasive material on the pad drivers. To change the abrasive material a mechanical lift, a lever, may be incorporated to lift the housing up enough to change the abrasive material. The housing and pad drivers are lifted off the floor in a cantilevered fashion off the supporting structure. In the preferred embodiment the mechanical lift raises the pad drivers about four inches off of the floor.

Sanding and screening operations produce a great amount of dust that is not only a fire hazard and health hazard, but must be meticulously removed before the floor can be stained or a polish coat can be applied. A suction generating assembly, to suction the dust generated by the floor finisher e.g. a vacuum cleaner, is provided. The suction generating assembly is connected to the housing by a dust pipe fitted into the housing just over the pad driver to suction the dust away from the sanding operation.

In the preferred embodiment there are two pad drivers, each driven by an individual 220 Volt AC motor, although any convenient plurality of pad drivers with motors could be used. With two pad drivers the motors may drive the pad drivers in the same torsional direction, both clockwise or both counterclockwise, but they are preferably driven in opposite directions. Having one pad driver driven clockwise and the other counterclockwise at substantially the same RPM counterbalances any left or right pull on the floor finisher during operation that would occur otherwise. This counterbalancing of the two motions likewise gives a better finish to the floor being treated.

The pad drivers are covered with an abrasive material such as sandpaper, Emory paper or metal mesh for example, as appropriate to type of wood and type of abrading that is required for a particular floor finishing. These types of abrasive materials and the appropriate use of them in floor finishing are well known in the art.

When using two motors it is desirable to have both motors switched in tandem to keep them turning at the same RPM while in operation. Multi-speed switches are also desirable to allow different sanding speeds, and therefore the preferred embodiment incorporates a two-speed switch, well known in the art, that allows the motors to be run at either speed or be shut off entirely.

Any feature or combination of features described herein is included within the scope of the present invention provided that the features of any such combination are not mutually inconsistent.

Additional aspects and advantages of the present invention are set forth in the following description and claims, particularly when considered in conjunction with the accompanying drawings in which like parts bear like reference numerals.

DETAILED DESCRIPTION OF THE DRAWINGS

The following detailed description, and the figures to which it refers, are provided for the purpose of describing example(s) and specific embodiment(s) of the invention only and are not intended to exhaustively describe all possible examples and embodiments of the invention.

Figure 1:
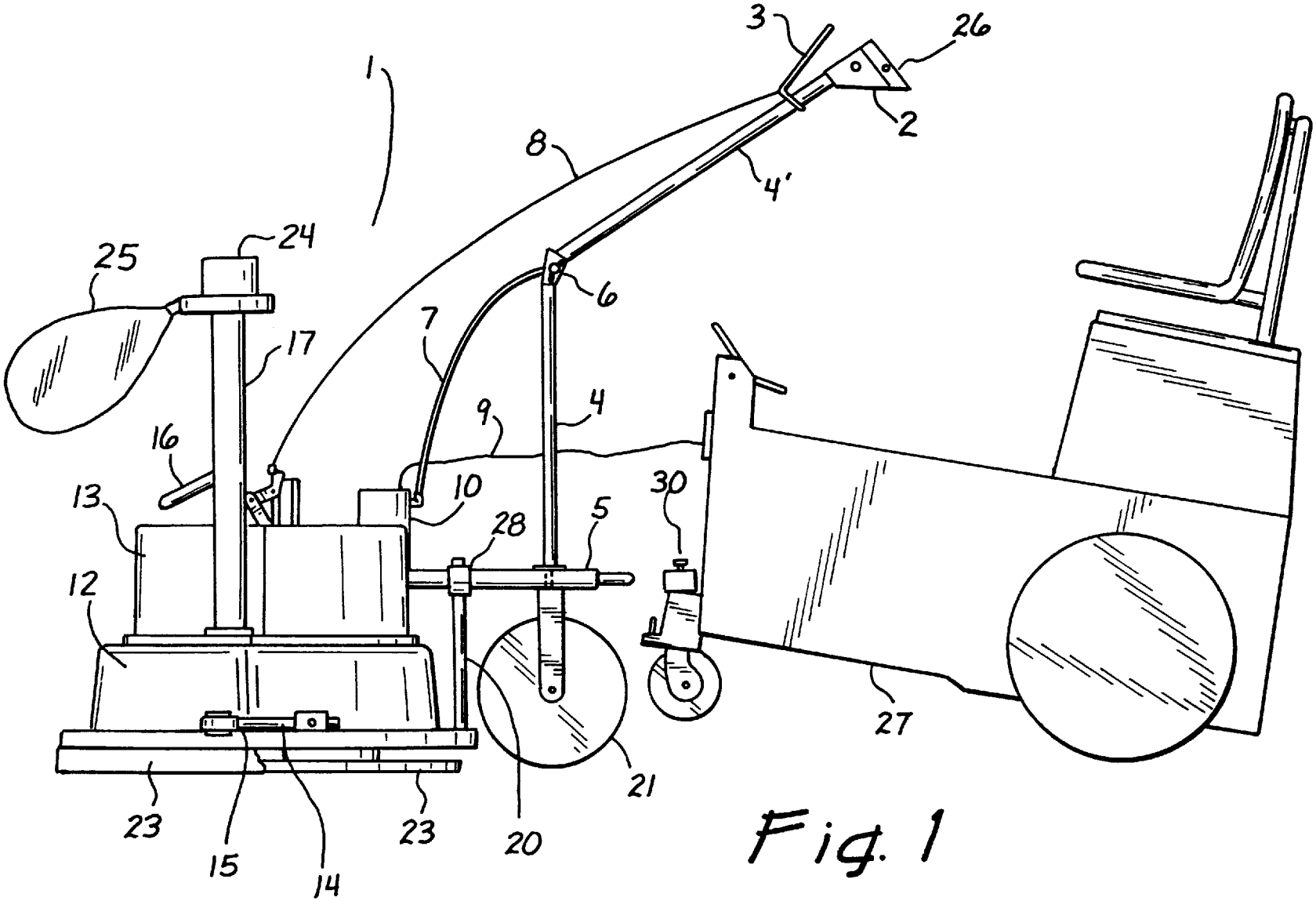
FIG. 1 is a schematic side view of the preferred embodiment of the current invention.
Figure 2:
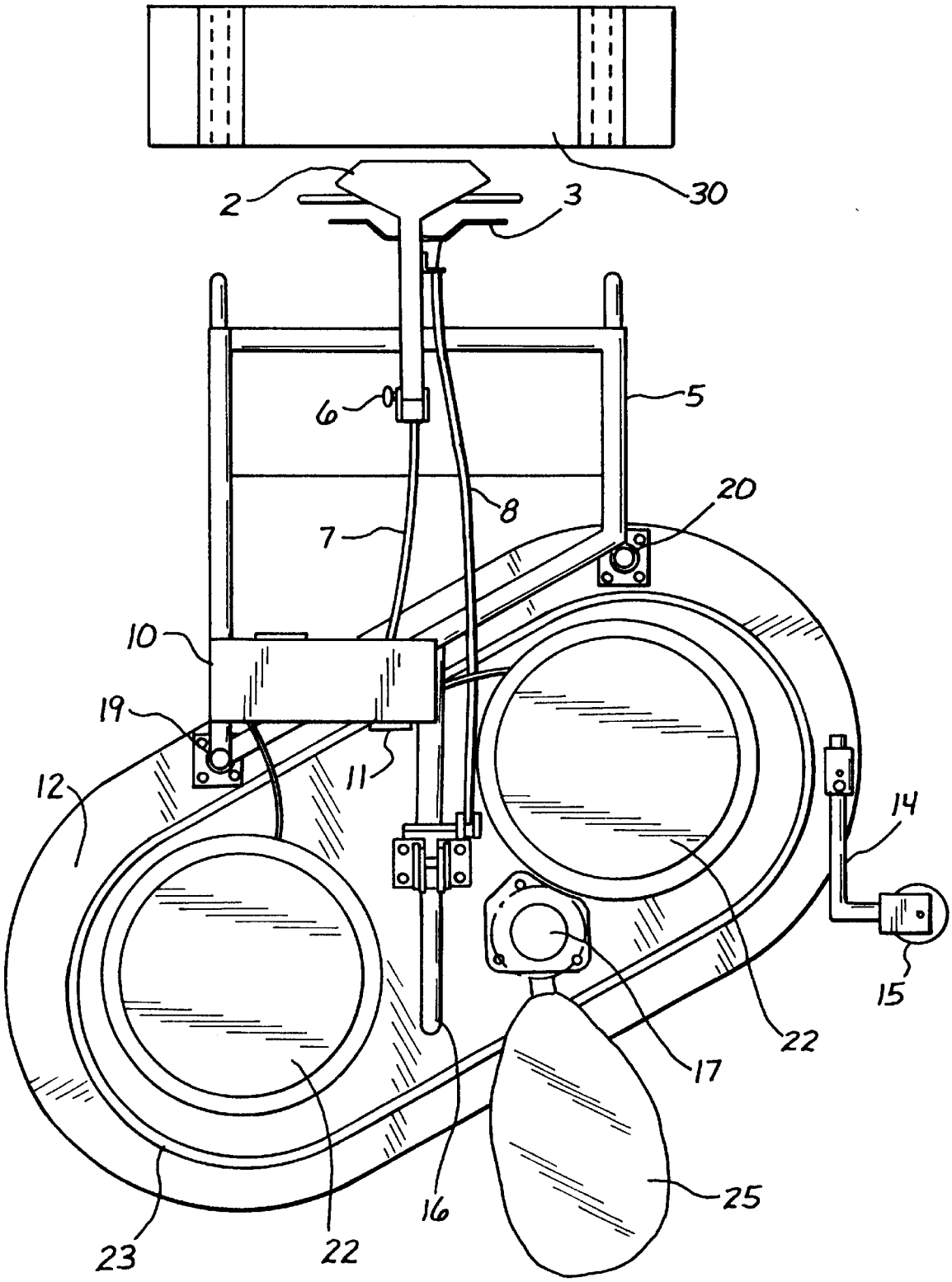
FIG. 2 is a schematic top view of the preferred embodiment of the current invention.

FIGS. 1 and 2 depict elements of the preferred embodiment of the present invention.

Referring now to FIG. 1, there is shown a floor finisher 1 of the present invention. The supporting structure 5 of the floor finisher is aligned to be attached on a first side to the hook-up bracket 30 of power rider trailer 27. It is much preferred that the power rider trailer and the supporting structure be attached in fixed relation to one another in order to allow them to move and be steered as a unit, because they would be more difficult to steer if they were allowed to articulate in relation to each other. A wheel 21 is pivotally attached to the supporting structure and supports the supporting structure on the floor. The wheel can be steered with a handle arm comprised of handle arm 4' and handle arm base 4. The height of the handle can be adjusted with handle height adjustment knob 6.

A housing 12 is joined to a second side of supporting structure 5, in the preferred embodiment opposite the first side, by two linear bearings, left linear bearing shown at 28. Each linear bearing is slidably affixed to a base member attached to the housing, left base member shown at 20. The base members slide vertically along through the linear bearings when the housing 12 is lifted away from or lowered down towards the floor and thereby keep the plane of the pad drivers 23 at all times in parallel relation to the plane of the floor.

The housing is lifted or lowered by two mechanisms. Mechanical lift handle 16 is pulled upwards to leverage the housing away from the floor along the lift members, left hand lift member 20 shown, to allow room for the abrasive material affixed to the face of the pad drivers to be changed, optimally raised about four inches off the floor.

The housing may also be incrementally lifted by the user pressing on pressure release handle 3, which lifts the housing unit as a whole to reduce the pressure exerted on the pad drivers. The pressure release handle is calibrated to lift the pad drivers to reduce the weight on them by fifty percent of the initial, unloaded, weight of the combined housing, motors and pad drivers.

Any available ballast (not shown) may be placed atop the housing to increase the weight added to cause the abrasive material to abrade more, but should be centered to provide an equal distribution of the weight on the pad drivers.

Power is supplied by an available wall outlet supplying preferably 220-volt AC electricity to electrical box 10 (not shown). The motors 13 of the floor finisher 1 are preferably 220 volt AC motors supplied electrical current from electrical box 10. The power rider itself is powered by through incoming electrical line 9, connecting the power rider trailer outlet to electrical box 10 as well. A two-speed switch, not shown, in electrical box 2 is connected to electrical box 10 by power cable 7 and appropriately wired to allow the user to switch the floor finisher off and on, as well as to select one of two operating speeds.

The electrical components of the finisher are centrally wired from electrical box 10, which in turn is electrically connected to an available electrical.

A suction generating assembly 24 is connected to the housing 12 by a dust pipe 17 to remove wood dust generated by the abrading operation. The suction generating assembly exhausts the dust to be held by removable dust bag 25. The scattering of dust is further prevented by skirt portion 23, which prevents the dust from being scattered on either side of the finisher during operation.

A guide wheel is provided on one or both sides of the floor finisher, here shown as transport wheel guide 16, affixed to and held away from the housing transport wheel guide 15. This wheel prevents the user from inadvertently bumping against a wall adjacent a floor, preventing damage to the wall, the housing 12, as well as preventing the floor finisher from being jostled and creating an uneven floor abrasion at that point.

Referring now to FIG. 2, there is shown the same floor finisher, with like numbers referring to like components of the invention. The connection between the supporting structure 5 and the hook-up bracket 30 is more explicitly depicted, the supporting structure having two members that attach to the hook-up bracket. This arrangement prevents the floor finisher from articulating in relation to the power rider trailer and thereby ensures that the combined unit can be steered together.

The housing 12 is shown connected to the supporting structure by right hand lift member 19 and left hand lift member 20. Mechanical lift 16 lifts the housing along the lift members to raise the housing and pad drivers 22 off the floor. Pressure release member 8, here a cable, is incorporated into the mechanical lift to slightly pull on the mechanical lift when the user pulls on pressure release handle 3.

The pad drivers are shown in diagonal relation to the power rider trailer. This configuration is used because the abrasive material can then be affixed to overlap slightly at the center and ensure that no floor area is missed between the two pad drivers.

Transport wheel guide 15 is shown affixed to and held away from the housing transport wheel guide arm 14. This wheel prevents the user from inadvertently bumping against the wall adjacent a floor.

Dust pipe 17 is attached on one end to suction generating assembly 24, not shown, and on the other end to the housing between the pad drivers to most optimally suction dust generated by abrading the floor away from the pad drivers and the floor itself. The dust is retained in suction generating assembly bag 25.

The floor finisher is centrally wired from electrical box 10 and switched from a switch in handle electrical box 2.

It will be appreciated that the invention has been described hereinabove with reference to certain examples or preferred embodiments as shown in the drawings. Various additions, deletions, changes and alterations may be made to the above-described embodiments and examples without departing from the intended spirit and scope of this invention. Accordingly, it is intended that all such additions, deletions, changes and alterations be included within the scope of the following claims.

What is claimed is:

1. A floor finisher comprising:

a supporting structure adapted to be substantially rigidly attachable on a first side to the hook-up bracket of the power rider trailer, a housing attached to the supporting structure on a second side of the supporting structure, at least one motor mounted on the housing and drivingly coupled to one or more pad drivers to rotate the one or more pad drivers about an axis generally perpendicular to a floor, a steerable wheel the supporting the supporting structure on a floor, and a handle arm directly coupled to the wheel so that the wheel is steered in direct response to movement of the handle.

2. A floor finisher as described in claim 1, wherein the motor is an electric motor.

3. A floor finisher as described in claim 1, wherein the housing is sized and structured to be lifted on the supporting structure from the floor.

4. A floor finisher as described in claim 1, further comprising a pressure release member positioned with respect to the one or more pad drivers to adjust the amount of force the pad driver exerts against the floor.

5. A floor finisher as described in claim 1, including a suction generating assembly connected to the housing to suction dust generated by the floor finisher.

6. A floor finisher as described in claim 1, wherein the at least one motor is two motors mounted on the housing, one or more pad drivers drivingly coupled to each of the motors to rotate the one or more pad drivers about an axis generally peroendicular to a floor.

7. A floor finisher as described in claim 6, further comprising a pressure release member positioned with respect to the pad drivers to adjust the amount of force the pad drivers exert against a floor.

8. A floor finisher as described in claim 6, further comprising a suction generating assembly connected to the housing to suction dust generated by the floor finisher.

* * * * *

UNITED STATES PATENT AND TRADEMARK OFFICE

CERTIFICATE OF CORRECTION

PATENT NO. : 6,419,565 B2
DATED : July 16, 2002
INVENTOR(S) : Mattson et al.

It is certified that error appears in the above-identified patent and that said Letters Patent is hereby corrected as shown below:

Column 6,
Line 29, "the hook-up bracket of the" should read -- a hook-up bracket of a --.
Line 47, "structure from" should read -- structure away from --.
Line 51, "pad driver" should read -- one or more pad drivers --.

Signed and Sealed this

Twenty-third Day of December, 2003

JAMES E. ROGAN
*Director of the United States Patent and Trademark Office*